United States Patent [19]

Gray et al.

[11] Patent Number: 4,470,543

[45] Date of Patent: Sep. 11, 1984

[54] RAIL FASTENING

[76] Inventors: Laurence W. Gray, 322 Princess St., Kingston, Ontario, Canada, K7L 1B6; Ronald J. Aitken, 1696 Victoria St., Kingston, Ontario, Canada, K7M 5H5

[21] Appl. No.: 363,659

[22] Filed: Mar. 31, 1982

[30] Foreign Application Priority Data

Mar. 31, 1981 [CA] Canada ..... 374284

[51] Int. Cl.[3] ..... E01B 9/30; E01B 9/48; E01B 9/66

[52] U.S. Cl. ..... 238/341; 238/349; 238/352

[58] Field of Search ..... 238/341, 347, 349, 352, 238/281, 310, 343, 356

[56] References Cited

U.S. PATENT DOCUMENTS

| | | | |
|---|---|---|---|
| 1,470,090 | 10/1923 | Manning | 238/341 |
| 1,998,043 | 4/1935 | Boyd et al. | 238/349 X |
| 2,168,324 | 8/1939 | Case | 238/341 |
| 2,174,472 | 9/1939 | Morano | 238/356 |
| 2,386,315 | 10/1945 | Holstein | 238/349 X |
| 3,282,507 | 11/1966 | Holstein | 238/349 |
| 3,430,857 | 3/1969 | Matsubara et al. | 238/349 X |
| 4,143,818 | 3/1979 | Matsubara et al. | 238/349 |
| 4,304,359 | 12/1981 | Fischer | 238/349 |
| 4,325,510 | 4/1982 | Sherrick | 238/341 |

FOREIGN PATENT DOCUMENTS

| | | | |
|---|---|---|---|
| 856157 | 11/1953 | Fed. Rep. of Germany | 238/349 |
| 19021 | of 1914 | United Kingdom | 238/343 |

*Primary Examiner*—Howard Beltran

*Attorney, Agent, or Firm*—Norbert P. Holler; Charles A. Blank

[57] ABSTRACT

A rail fastening is provided which permits vertical adjustment of the rail relative to the bed. A shoulder is secured to the bed and a clip retainer adjustably mounted on the shoulder. The clip retainer includes a clip receiving bore in which one end of the clip is received. The clip retainer may be adjusted relative to the shoulder to adjust vertically the position of the clip receiving bore relative to the bed. Intermeshing teeth are provided between the shoulder and the clip retainer to lock the retainer to the shoulder in the required position.

15 Claims, 3 Drawing Figures

RAIL FASTENING

The present invention relates to apparatus for fastening rails to a support structure to provide a railway track.

It is well known to provide a railway track by means of a pair of parallel rails which are supported upon cross ties. Conventionally the cross ties are themselves supported on a bed of granular material such as crushed stone to properly support the loads placed on the track as a train passes. The use of the crushed stone bed enables variations in grade to be evened out so that a smooth bed may be provided for the track. Whilst the bed is generally planar it is also preferable to spiral the track upon entering curves which requires an elevation of one side of the track to the other. Again the use of the crushed stone bed enables the bed to be contoured to provide the necessary support for the ties.

The material conventionally used for the ties of the railway track is wood. However in recent years there has been an increased interest in the use of concrete and steel as ties for railroad track. These materials have been adopted in conjunction with the conventional granular bed to provide the support and gradual change in grade required to adequately support the track. There is now however an interest in the use of light railways for use in a mass transit system in urban areas and several proposals require the use of elevated track in order to maintain cost and disturbance to the enrivonment at a minimum. The elevated track is usually supported on a concrete structure. Whilst it is possible to utilize a conventional granular bed with such concrete structures, there is obviously a potential saving in cost and maintenance if the rails can be directly attached to the concrete or to ties. However a problem associated with such arrangements is that the concrete guideway cannot be formed with the necessary accuracy to provide a uniform grade for the track. It has previously been proposed to use shims between the underside of the track and the support structure to compensate for small differences in vertical height of the support structure. However a problem of such an arrangement is that with the conventional clips used to attach the rail to its tie or support structure, the vertical loading imposed on the rail will vary as the height of the rail relative to the support structure is varied. This variation in vertical loading is undesirable as it produces inconsistant loadings on the track.

It is therefore an object of the present invention to obviate or mitigate the above disadvantages and to provide a rail fastening in which vertical adjustment of the rail relative to its support structure may be accomplished.

According to the present invention there is provided a rail fastening comprising a base for attachment to a rail bed, a clip retainer adjustably mounted on said base, said clip retainer including a clip receiver to receive a rail engaging clip, said a clip receiver being vertically displacable relative to said shoulder upon adjustment of said clip retainer on said shoulder, and locking means to lock said clip retainer relative to said base.

An embodiment of the invention will now be described by way of example only in which.

Figure 1:
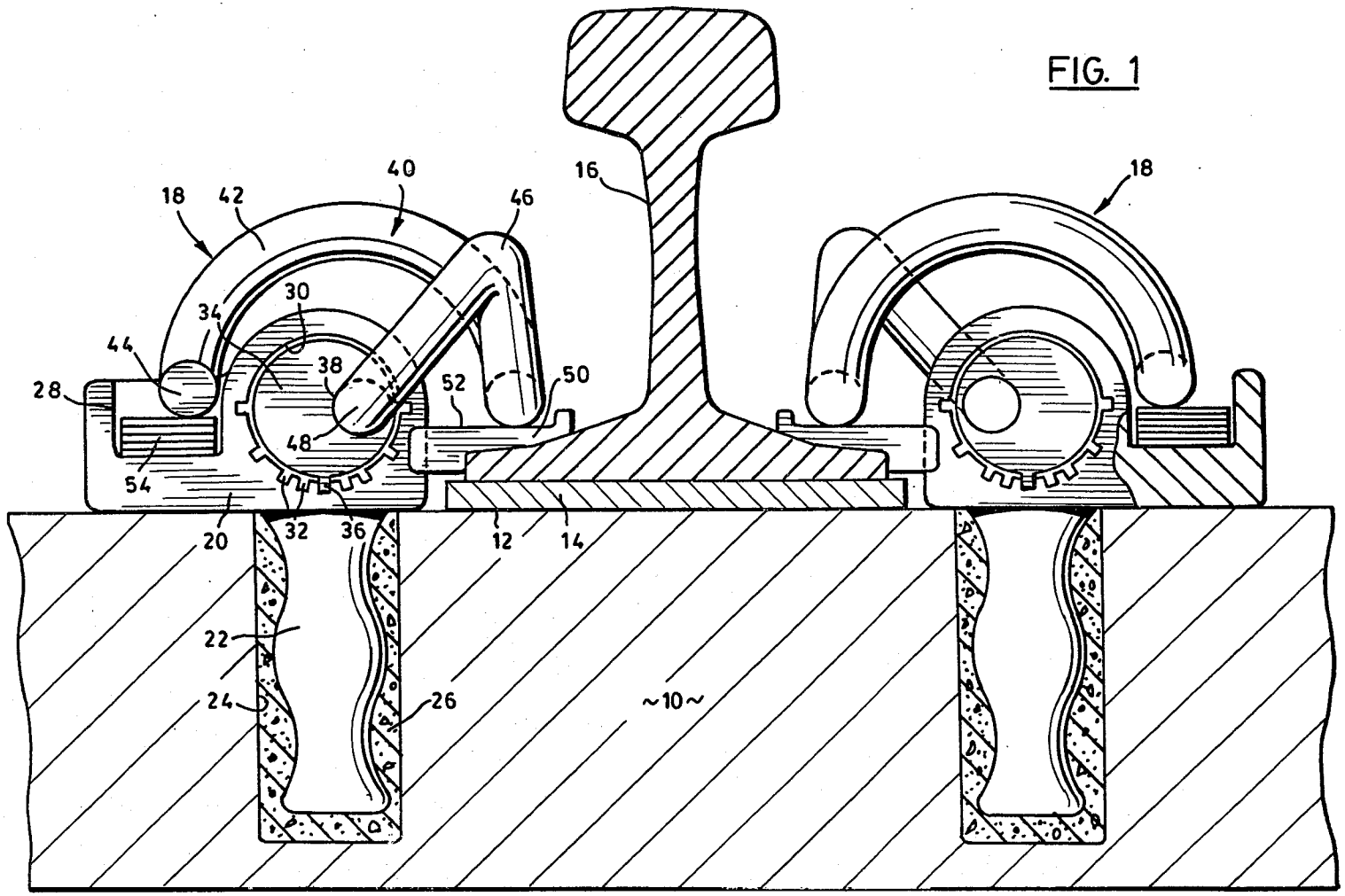
FIG. 1 is a cross section through a rail and fastening device.
Figure 2:
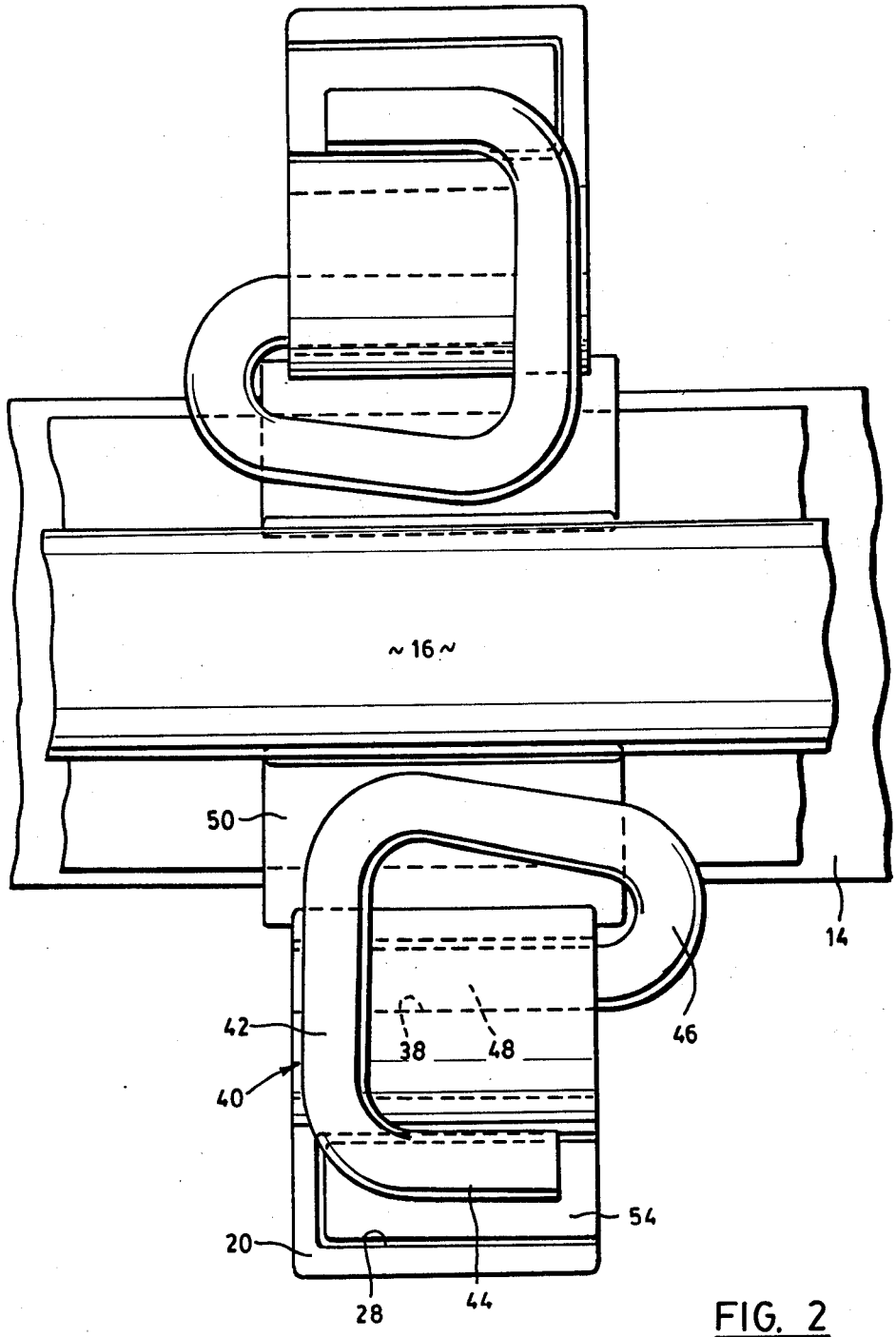
FIG. 2 is a plan view of the rail and fastening system shown in FIG. 1.

Referring now to FIG. 1, a concrete guideway 10 provides a rail supporting structure and may be in the form of either an individual tie or a part of an at grade or elevated concrete structure. The upper surface 12 of the structure 10 provides a support surface for a railway track. A resilient pad 14 is located on the upper surface 12 and supports a rail 16 in spaced relationship from the upper surface 12. The rail is secured in place by means of a pair of rail fastenings 18 which are identical and therefore only one will be described in detail.

The rail fastening 18 includes a base 20 from which depends an irregular pin 22. The pin 22 is received in a bore 24 preformed in the upper surface 12 of the concrete structure 10. The pin 22 is secured in place by means of an epoxy grout 26 which is cast insitu with the pin placed in the bore 24. The irregular shape of the pin 22 provides adequate location for the rail fastening 18 relative to the concrete structure 10.

The base 20 is formed with a shoe 28 in the form of a channel recess below the upper surface of the base 20. Located adjacent to the shoe 28 is a longitudinal bore 30 whose access extends generally parallel to the axis of the rail 16. A number of depressions 32 are cut into the surface of the bore 30.

A cylindrical clip retainer 34 is mounted in the bore 30 and has a peg 36 projecting from the outer surface. The peg 36 is dimensioned to engage in a selected ne of the depressions 32 and thereby prevent rotation of the clip retainer relative to the shoulder. The peg 36 therefore acts as a locking device to locate the clip retainer relative to the shoulder.

A clip receiving bore 38 is formed in the clip retainer 34 to extend generally parallel to the longitudinal axis of the retainer. The clip receiving bore 38 is displaced from the axis and is dimensioned to snugly receive one end of a rail clip 40.

The rail clip 40 vertical adjustment of the clip receiving bore 38 is achieved prior to the bore 38 receiving the rail engaging clip 40. The clip retainer 34 is slid into the bore 30 at such an orientation that the peg 36 engages with one of the recesses 36 and by selecting which recess 32 the peg 36 is to engge, the height of the bore 38 relative to the base 20 and to rail 16 can be selected. is of generally known construction and is widely referred to as a Pandrol (a trademark) clip. The clip 40 has an arched portion 42 which terminates at one end in a leg 44 extending generally parallel to the axis of the rail. The other end of the arched portion merges with a second arched portion 46 which terminates in a leg 48 received within the clip receiving bore 38. The legs 44, 48 are therefore spaced apart in the transverse horizontal direction and the junction between the two arched portions 42, 46 bears against a spacer plate 50 positioned on the toe of the rail.

The spacer plate 50 conforms to the cross section of the rail 16 and provides an upper planar surface 52 against which the junction of the arched portions bears. The upper planar surface 52 therefore permits lateral adjustment of the rail relative to the rail fastening 18 without varying the vertical spacing between the upper surface 12 and the contact point of the clip with the spacer plate 50.

The leg 44 lies in the shoe 28 and is supported on a shim stack 54. The stack 54 is chosen to maintain the toe load at the required value for variations in the relative height of the rail and the rail fastening 18.

Figure 3:
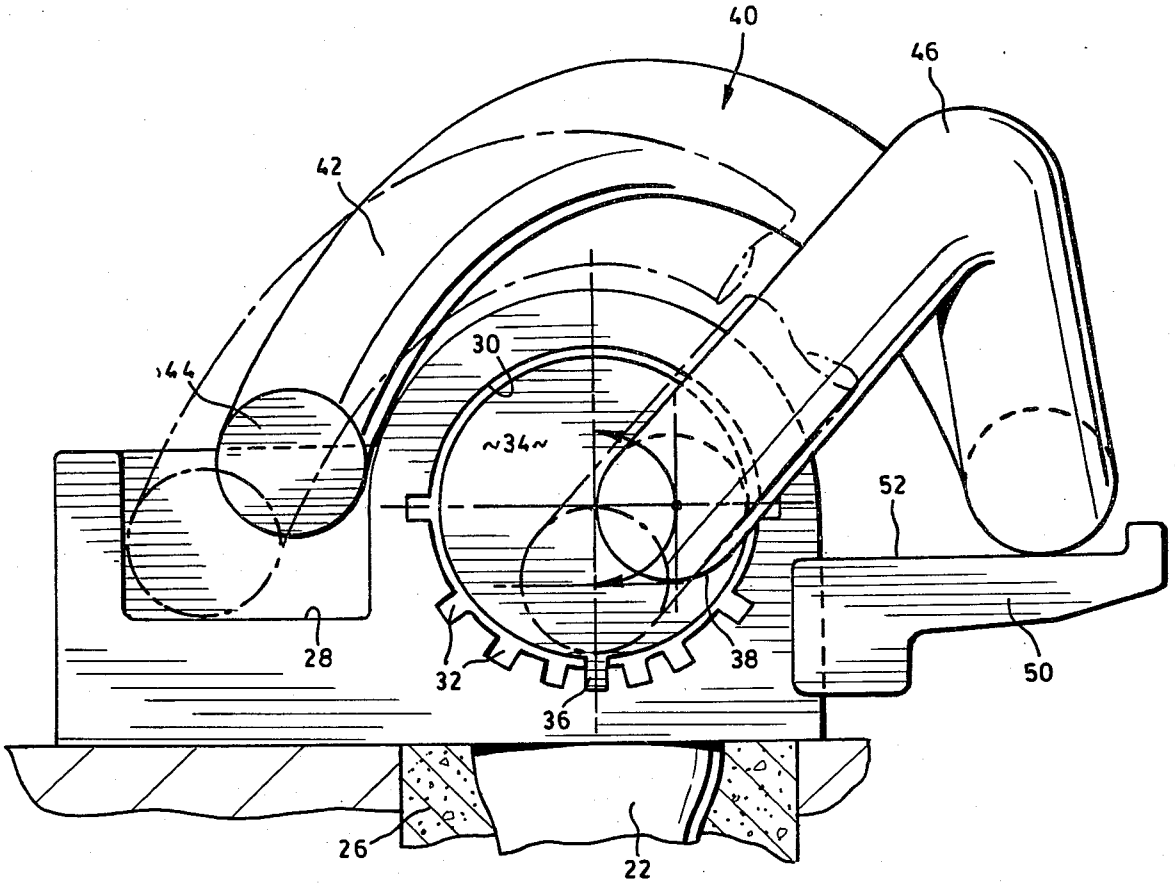
FIG. 3 is an enlarged view of a portion of the fastening system shown in FIG. 1 with an alternate position of the fastening system shown in chain dot lines.

To install the rail 16 on the structure 10, the rail fastenings 18 are secured to the structure 10 by locating the pin 22 in the bore 24 and pouring the epoxy grout into the bore. To obtain the required grade and compensate for any small deviations of the grade in the upper surface 12, a resiliant pad 14 of required thickness is chosen. The rail is placed on the upper surface of the pad 14 and a spacer plate 50 positioned on each side of the toe of the rail 16. The clip retainer 34 is then positioned within the bore 30 with the peg 36 engaging an appropriate one of the depressions 32 to position the clip receiving bore 38 at the required height relative to the rail. Should a relatively thick pad 14 be required to support the rail 16 at the required height, the peg 36 will be located in one of the depression 32 to the right of the center line of the pin 22 when viewed in FIG. 1 so that the base 38 is moved upwards. Similarly should a relatively thin resilient pad 14 be required, the peg 36 will be located in one of the depressions 32 to the left of the center line of the pin 22 so that the base 38 is moved upwards. In general, the position of the peg 36 in the depression 32 should be chosen to maintain the axis of the bore 38 at a constant height above the upper planar surface 52. At the same time, the thickness of the shim stack 54 is selected in accordance with the position of the peg 36 in the depression 32. Where a relatively thin pad 14 is required, a correspondingly thin shim stack 54 will also be required as the location of the clip receiving bore 38 will move down towards the upper surface 12. This effect is best seen in FIG. 3 in which the solid lines indicate the position of the clip 40 with the peg 36 engaged in the median position of the depression 32. The chain dotted outline indicates the position obtained by the clip 40 with the peg 36 located in the extreme clockwise depression 32.

With the position of the clip retainer 34 and the thickness of the shim stack 54 selected, the clip 40 may be located by simply positioning the leg 48 in alignment with the bore 38. The clip 40 is then pulled axially so that the leg 48 enters the bore 38 and the leg 44 rides up onto the upper surface of the shim stack 54. The clip 40 is then maintained in position with a predetermined preload acting on the toe of the rail. It would be seen that by varying the position of the peg 36 in a depression, the preload on the toe of the rail 16 may be maintained constant with varying thicknesses of the pad 14. This therefore permits vertical adjustment of the rail relative to the concrete structure 10 whilst enabling the rail fastening 18 to be secured directly to the structure 10. This device therefore enables the concrete guideways to be utilized without requiring a conventional granular rail bed and enables the required toe loading on the rail to be maintained.

Whilst a single peg 36 has been shown as the preferred locking structure for securing the clip retainer to the shoulder, it will be appreciated that other forms of locking structure could be provided. For example a regular splined connection could be provided to distribute the load between a number of teeth of these spline. Similarly a locking bolt passing radially through the shoulder and the clip retainer could be used.

The concrete may be cast in place or pre-cast. Whilst the epoxy grout 26 has been shown for securing the pin to the structure it will be appreciated that other forms of securing means could be provided. For example, the pin 22 could be placed directly into the wet concrete during the casting process of the guideway or tie.

The embodiments of the invention in which an exclusive property or privilege is claimed are defined as follows:

1. A rail fastening comprising a base for attachment to a rail bed a pair of spaced clip retainers located on said base to receive respective opposite ends of a rail engaging clip having an intermediate portion extending between said clip retainers and into engagement with a rail, one of said clip retainers being adjustably mounted on said base and including clip receiving means to receive one of said ends of said rail engaging clip, said clip receiving means being vertically displaceable relative to said base upon adjustment of said one clip retainer on said base, and locking means to lock said one clip retainer relative to said base.

2. A rail fastening as claimed in claim 1 wherein the base includes attachment means adapted to secure the base to a support.

3. A rail fastening according to claim 1 wherein said one clip retainer is rotatably mounted in a bore in said base.

4. A rail fastening according to claim 3 wherein said clip receiving means includes a bore formed in said one clip retainer and displaced from the axis of rotation of said one clip retainer.

5. A rail fastening according to claim 4 wherein said locking means includes intermeshing formations located between said clip retainer and said bore in said base.

6. A rail fastening as claimed in claim 1 wherein the other of said clip retainers includes a recess formed in said base and adapted to receive the other of said ends of the rail engaging clip.

7. A rail fastening as claimed in claim 6 including shim means positionable between the clip and a floor of the recess, the height of the shim means relative to the floor being variable whereby the load applied to the rail is maintained at a predetermined value to accommodate variations in the relative height of the rail and the base.

8. A rail installation comprising a rail, a rail fastening for attachment to a rail bed and a clip extending between said fastening and said rail to exert a restraining force thereon, said clip having laterally spaced opposite ends for support on said fastening and an intermediate portion for engagement with said rail, said base including a pair of laterally spaced clip retainers to retain respective ends of said clip, on said base, one of said clip retaining means including vertically adjustable clip receiving means to receive a respective end of said clip to vary the location thereof relative to said base and lock means acting between said one clip retaining means and said base to inhibit relative movement therebetween.

9. A rail fastening as claimed in claim 8 wherein shim means are locatable between the rail engaging clip and a rail, the shim means having a substantially flat upper surface and being dimensioned such that the rail engaging clip can be moved laterally relative to the rail fastening.

10. A rail installation according to claim 8 wherein a spacer is located between said rail and said rail bed and said clip receiving means is adjusted to maintain a predetermined configuration for said clip.

11. A rail installation according to claim 10 wherein said ends of said clip are laterally spaced on said base and extend generally parallel to said rail.

12. A rail installation according to claim 11 wherein said clip receiving means includes a bore provided in said one clip retainer and having an axis generally parallel to said rail.

13. A rail installation according to claim 12 wherein said one clip retainer is rotatable about an axis parallel to and spaced from the axis of said bore.

14. A rail installation according to claim 13 wherein said lock means includes interengaging formations on said base and said one clip retainer.

15. A rail installation according to claim 14 wherein said interengaging formations include a plurality of recesses on one of said base and said clip retainer and a projection on the other of said base and said clip retainer.

* * * * *